US005875639A

United States Patent [19]

Kim et al.

[11] Patent Number: 5,875,639

[45] Date of Patent: Mar. 2, 1999

[54] WIND DIRECTION CONTROL METHOD FOR AIR CONDITIONER

[75] Inventors: Nam-Sick Kim, Yongin; Joong-Ki Mun, Seoul, both of Rep. of Korea

[73] Assignee: Samsung Electronics Co., Ltd., Suwon, Rep. of Korea

[21] Appl. No.: 850,384

[22] Filed: May 2, 1997

[30] Foreign Application Priority Data

Oct. 8, 1996 [KR] Rep. of Korea ..... 1996 44646

[51] Int. Cl.[6] ..... F25D 17/04

[52] U.S. Cl. ..... 62/186; 454/256; 236/51

[58] Field of Search ..... 62/180, 186; 236/51; 454/256

[56] References Cited

U.S. PATENT DOCUMENTS 4,671,458 6/1987 Fukuda et al. .
5,251,814 10/1993 Warashina et al. .
5,331,825 7/1994 Kim ..... 62/180

*Primary Examiner*—Henry Bennett
*Assistant Examiner*—Susanne C. Tinker
*Attorney, Agent, or Firm*—Burns, Doane, Swecker & Mathis, L.L.P.

[57] ABSTRACT

Disclosed is a wind direction control method for an air-conditioner which effectively controls a wind direction of discharge air according to a position of the air-conditioner. In the air-conditioner which divides the room into a plurality of zones and has a human body sensor for sensing a human body position in each divided zone, the present invention senses whether a human body is present in each zone by using the plurality of human body sensors, calculates a time ratio every zone according to the human body presence time, compares the time ratio with first and second proportional constants, varies a driving range of a louver according to a compared result, and controls a wind direction of the discharge air. A wind direction control method for an air-conditioner varies a wind direction of a discharge air according to a human body existence time ratio in each zones, prevents a deterioration of the air-conditioning performance and a power-consumption due to cool air's discharge towards an empty space, thereby performing an effective air-conditioning operation.

2 Claims, 8 Drawing Sheets

WIND DIRECTION CONTROL METHOD FOR AIR CONDITIONER

BACKGROUND OF THE INVENTION (1) Field of the Invention

The present invention relates to a wind direction control method for an air-conditioner. More particularly, it relates to a wind direction control method for an air-conditioner which varies a wind direction of discharge air according to a sensed amount of time of a human body is present in certain zones where the air-conditioner is installed.

(2) Description of the Prior Art

FIG. 4 is a block diagram of a conventional air-conditioner having sensing capabilities to sense positions of persons, and FIG. 5 is a flowchart illustrating a driving control method of the conventional air-conditioner having sensing capabilities.

Referring to FIG. 4, the conventional air-conditioner having sensing capabilities includes: a human body sensor 12 for sensing a position of a human body, and sensing a distance between the air-conditioner and a human body; a main controller 2*b* for performing a main control of the air-conditioner; a set temperature variation portion 2*c* for varying a set temperature; a ventilation variation portion 2*d* for varying a ventilation direction; wind direction control flaps 2*e* for horizontally and vertically varying the ventilation direction; a wind direction control flap driving portion 2*i* for driving the wind direction control flaps 2*e*; a wind velocity variation portion 2*g* for varying a ventilation velocity; a ventilator 2*h* for performing ventilation; and a ventilator driving portion 2*f* for driving the ventilator 2*h*.

Referring to FIG. 5, a direction of a human body position is sensed by a human body sensor 12 in step S211. In a step S212, it is determined whether a human body is within a predetermined distance from the air-conditioner. If a human body is not within the predetermined distance, a step S211 is continuously repeated until a human body is sensed by the human body sensor 12 as being within a predetermined distance from the air-conditioner. Next, the set temperature variation portion 2*c* changes a set temperature determined by the user in step S213. Regarding the variation of the set temperature, the set temperature can be changed to be higher than a current indoor temperature for a heating operation, or the set temperature can be changed to be lower than the current indoor temperature for a cooling operation. Next, the ventilation variation portion 2*d* directs an airflow in the direction toward the human body in step S214. After this step, the wind velocity variation portion 2*g* changes a ventilation velocity to a high state in step S215. In step S216 it is determined whether or not a predetermined time has elapsed after operating the air-conditioner. If a predetermined time has elapsed in step S216, a series of operations are completed. If a predetermined time has not elapsed in step S216, the steps starting from the step S212 are repeated until a predetermined time has elapsed.

Referring to FIGS. 6A, 6B and 6C, the conventional air-conditioner is installed at a suitable indoor position. The human body sensor 12 divides a fan range into three zones R, C, and L and senses whether or not a human body is present in any of three zones R, C, and L. However, as shown in FIGS. 6B and 6C, zone D, in which the human body sensor 12 cannot sense whether a human body is present, is created if the air-conditioner is installed to either the right or left of the room. Further, zone D increases in size the more, the air-conditioner is installed to one side of the room.

Accordingly, not only is the sensing of a human body by the human body sensor 12 not possible in zone D, but as air from this zone can enter the other zones, an accurate sensing of the existence of a human body is not possible. As a result, fan control cannot be efficiently performed, reducing the overall performance of the air-conditioner.

Also, to prevent the creation of such a non-active zone, installation locations of the air-conditioner are greatly limited.

SUMMARY OF THE INVENTION

Accordingly, the present invention is directed to a wind direction control method for an air-conditioner that substantially obviates one or more of the problems due to limitations and disadvantages of the related art.

It is an objective of the present invention to provide a wind direction control method for an air-conditioner which controls a wind direction of discharge air according to variations in human body sensing degree in each human body sensing zone in response to an installation position of the air-conditioner, thereby enhancing air-conditioning performance.

To achieve the above objective, a wind direction control method for an air-conditioner according to the present invention divides an entire area being a dischargeable area of a heat-exchanged air into a plurality of zones, senses whether or not a human body is present in each zone, and controls a wind direction of the discharge air by varying the entire area according to the human body presence time in each zone.

A human body sensing method in a wind direction control method for the air-conditioner according to the present invention accumulates a human body sensing time in each zone dividing the entire area, extracts a human body presence time in at least two zones, computes a ratio of the human body presence time of one zone with respect to other zones, judges an installation position of the air-conditioner by comparing the computed ratio of each human body presence time with a predetermined proportional constant, varies a predetermined entire driving area of a louver according to the installation position of the air-conditioner, and controls a wind direction of the discharge air.

BRIEF DESCRIPTION OF THE DRAWINGS

Further objects and other advantages of the present invention will become appararent from the following description in conjunction with the attached drawings, in which.

DETAILED DESCRIPTION OF THE PREFERRED EMBODIMENT

The preferred embodiment of the present invention will now be described in detail with reference to the accompanying drawings.

Figure 1:
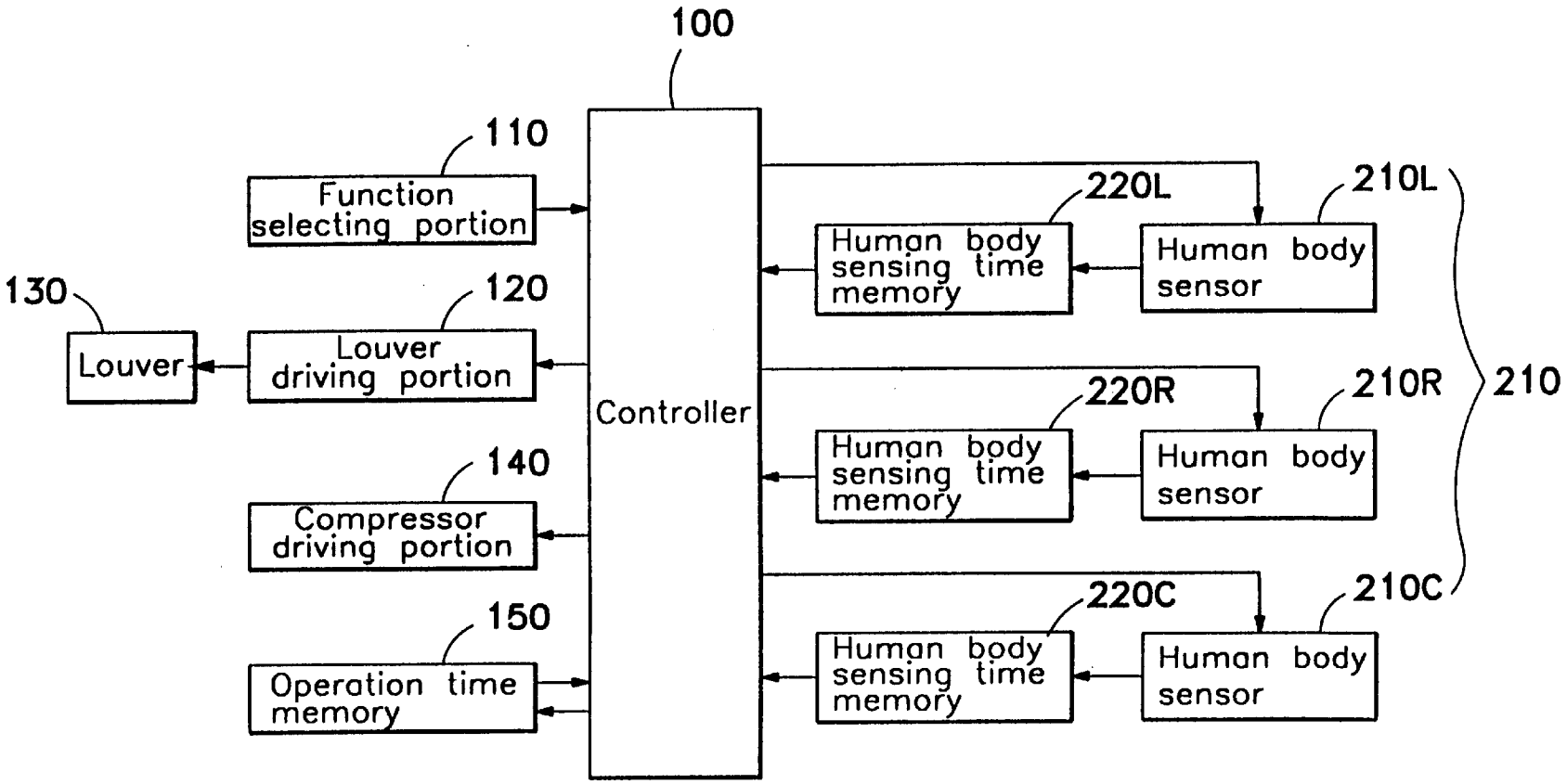
FIG. 1 is a block diagram of an air-conditioner according to the present invention.

FIG. 1 is a block diagram of an air-conditioner according to the present invention. As shown in FIG. 1, the air-conditioner according to the present invention includes: a function selecting portion 110 for receiving operation information from a user; a compressor driving portion 140 for driving a compressor and performing an air-conditioning operation after the user inputs an operation starting command to the function selecting portion 110; an operation time memory 150 for accumulating a driving time of the compressor and computing an entire air-conditioning operation time; and a plurality of human body sensors 210 for sensing a position of a user.

The plurality of human body sensors 210 sense whether or not a human body is present in each human body sensing zone formed by dividing a total air-conditioning space into predetermined zones. The air-conditioner according to the present invention also includes a human body sensing time memory 220 for accumulating and memorizing a human body sensing time in each human body sensing zone.

Further, the air-conditioner includes a controller 100 which receives results sensed by the human body sensor 210 from the human body sensing time memory 220 when the operation time memory 150 determines that a predetermined operation time has elapsed, computes a ratio of the human body sensing time every human body sensing zone, and determines a zone at which a human body sensing ratio is relatively low. The air-conditioner also includes a louver driving portion 120 which controls a driving of a louver 130 according to a control signal of the controller 100 such that a wind direction of the air discharged into a room is controlled.

Figure 2A:
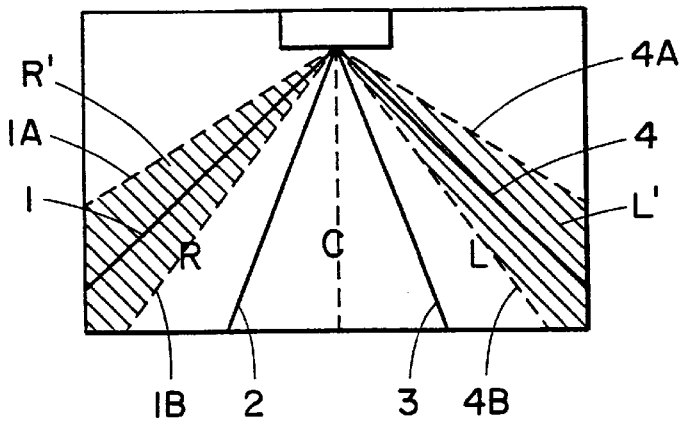
FIGS. 2A to 2E show actual zones for the air-conditioner according to the present invention.

In the present invention, it is preferable to use infrared sensors for the human body sensors 210. As shown in FIG. 2A, the room is divided into three zones (R, C and L). Three human body sensors 210 are provided in the air-conditioner to sense whether or not a human body is present.

Also, when infrared rays, emitted into each sensing zone of the room, are reflected and then received, the human body sensors 210 amplify a received signal by a predetermined magnitude, and compare the amplified signal with a predetermined reference voltage. Here, if a sensed signal is higher than the reference voltage, it is determined that a human body is present in a corresponding human body sensing zone. The human body sensors 210 output a human body sensing signal of a high signal, thus increasing a counting value of a timer of the human body sensing time memory 220 such that human body sensing times are accumulated in each human body sensing zone.

Further, as shown in FIG. 2A, an operating range of the louver driving portion 120 is initially set to discharge the heat-exchanged air into the three zones R, C and L. According to the control signal of the controller 100, which determines the human body sensing time in each zone, the louver driving portion 120 adds or subtracts the driving range by a oblique-lined area shown in FIG. 2A, thereby controlling a wind direction of the discharge air.

Figure 3A:
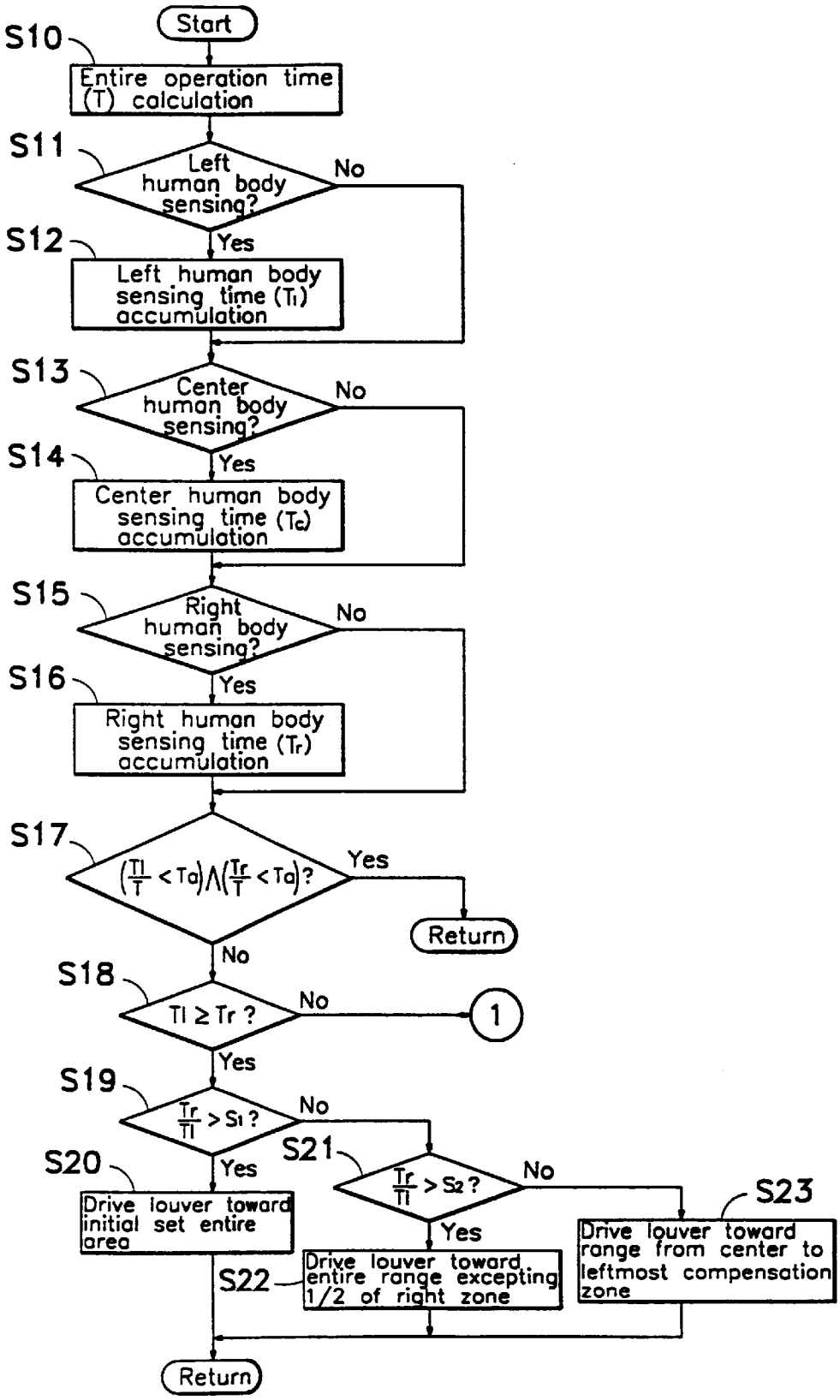
FIGS. 3A and 3B show a flowchart of a wind direction control method for an air-conditioner according to the present invention.
Figure 3B:
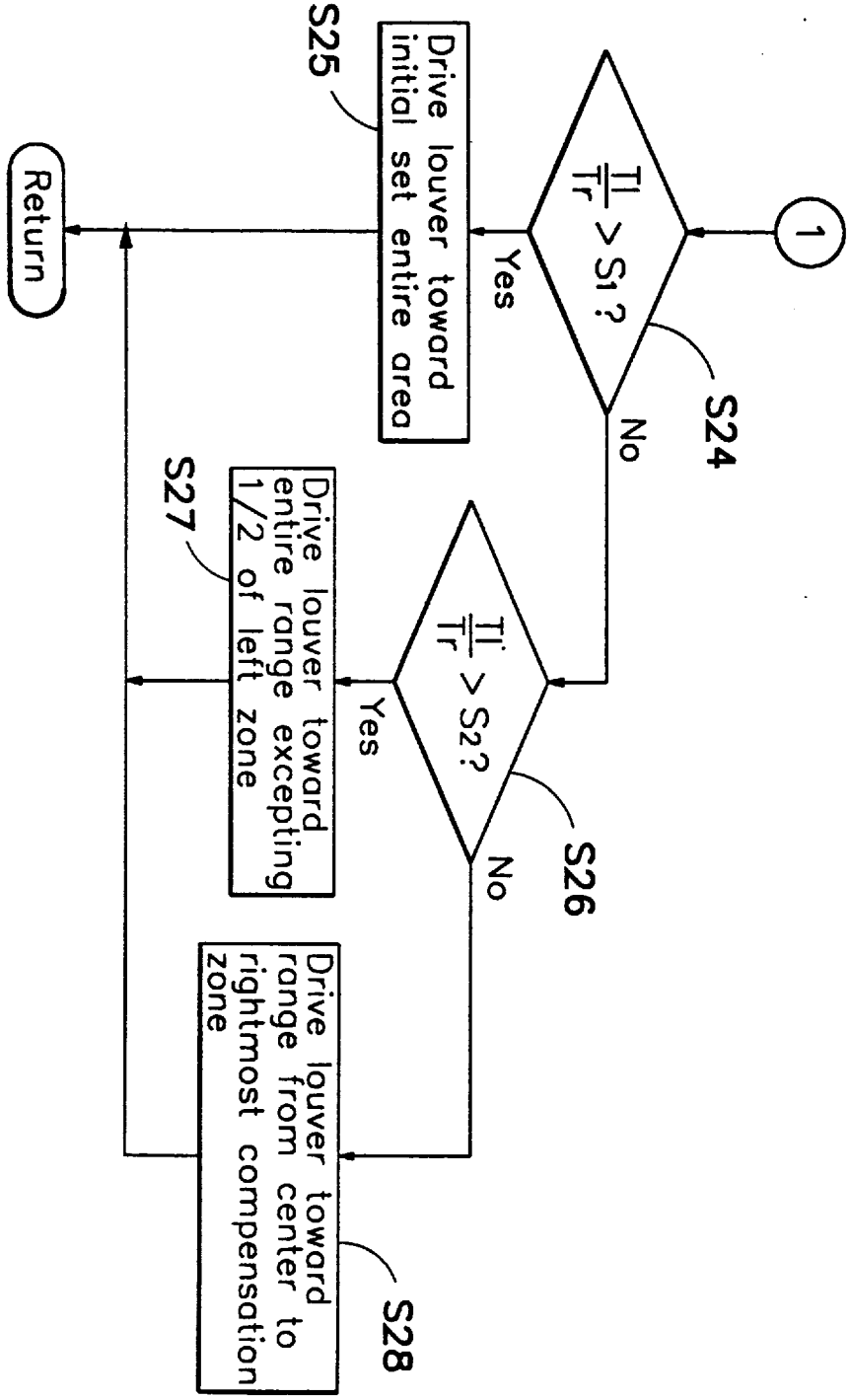
Figure 4:
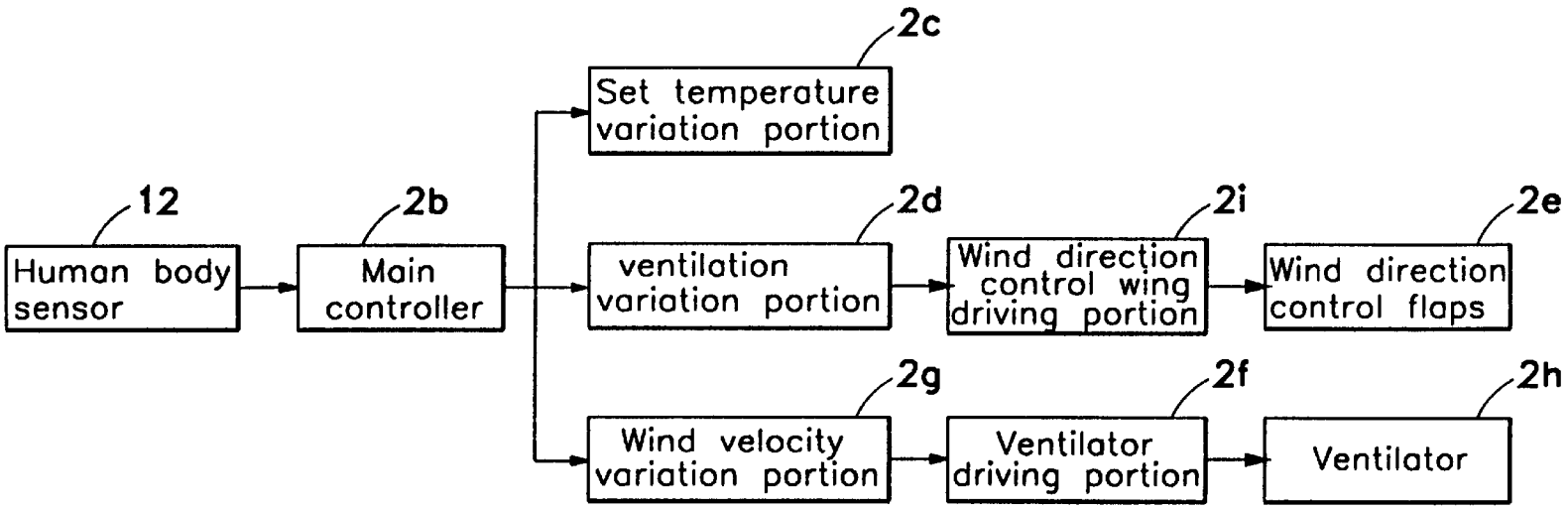
FIG. 4 (PRIOR ART)
FIG. 4 is a block diagram of the conventional air-conditioner having human body sensing capabilities.
Figure 5:
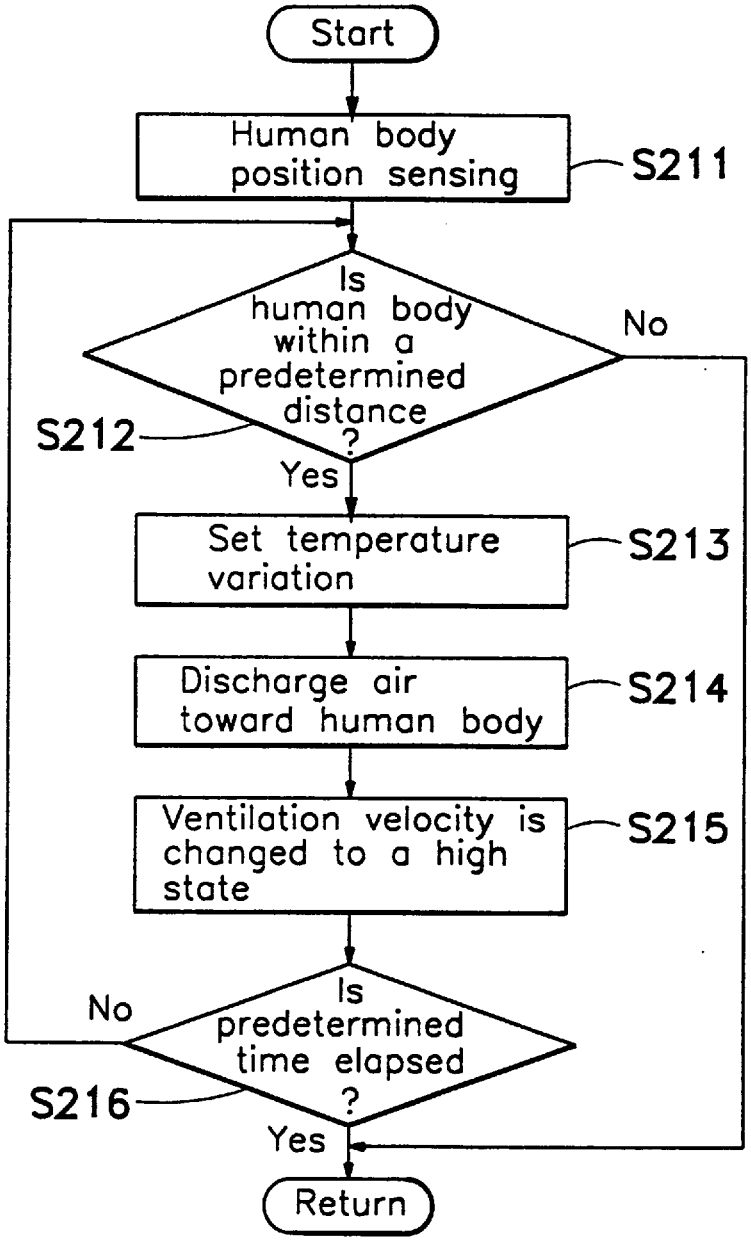
FIG. 5 (PRIOR ART)
FIG. 5 is a flowchart illustrating a wind direction control method of the conventional air-conditioner having sensing capabilities.
Figure 6A:
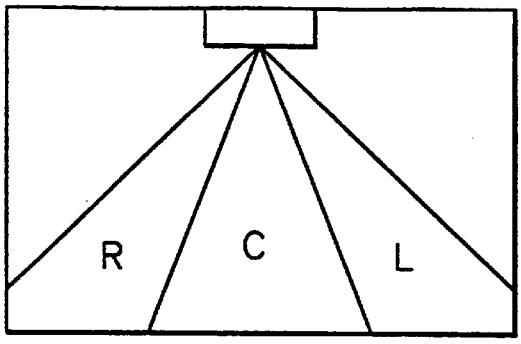
FIG. 6A (PRIOR ART)
FIGS. 6A, 6B and 6C illustrate problems of a wind direction control method of the conventional air-conditioner have sensing capabilities.
Figure 6B:
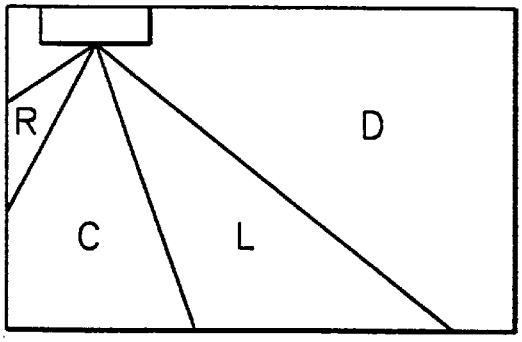
FIG. 6B (PRIOR ART)
Figure 6C:
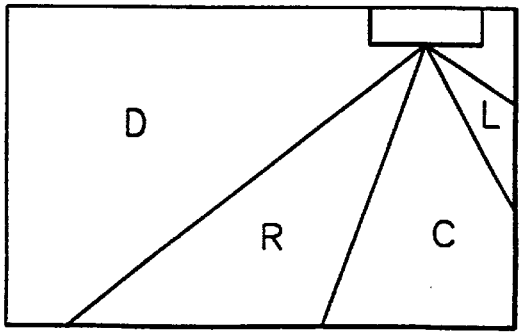
FIG. 6C (PRIOR ART)

A wind direction control method for the air-conditioner according to the present invention will now be explained hereinafter:

Referring to FIG. 3, there is shown a flowchart illustrating a wind direction control method for the air-conditioner according to the present invention.

The wind direction control method for the air-conditioner will now be described with reference to FIGS. 2A to 2E.

First, if the user inputs an operation starting signal by using an input key mounted into the function selecting portion 110, the controller 100 drives the compressor at a predetermined level of rpms by using the compressor driving portion 140, thereby performing a cooling or heating operation.

During the above process, the operation time memory 150 increases a counting value of a timer of the operation time memory 150 according to a driving time of the compressor in step S10, thereby accumulating an entire air-conditioning operation time T. In addition, the human body sensor 210L for sensing a left human body sensing zone L senses whether or not a human is present in the left zone L in step S11. If a human is present in the left zone L in step S11, the controller 100 increases a counting value of the timer of the human body sensing time memory 220L in a step S12, and accumulates human body sensing times Tl in the left zone L.

However, if no person is present in the left zone L, the human body sensor 210C senses whether or not a human is present in the center zone C in step S13. If a human is present in the center zone C, the controller 100 increases a counting value of a timer of a human body sensing time memory 220C in step S14, thereby calculating the human body sensing time Tc.

If no person is present in the center zone C in step S13, the human body sensor 210R senses whether or not a human is present in the right zone R in step S15. If a human is present in the right zone R in step S15, a counted value of a timer of the human body sensing time memory 220R increases in a step S16 while the human is being sensed in the right zone R, thereby calculating a right human body sensing time Tr.

In the meantime, the controller 100 divides the room into predetermined zones and senses whether or not a human is present in each zone by using human body sensors 210L, 210R and 210C. If a human is present in any zone, the controller 100 calculates ratios Tr/T and Tl/T of a human presence time within a corresponding sensed zone to an entire air-conditioning operation time T, and controls a wind direction of discharge air according to each time ratio calculated.

That is, during the operation time T accumulated into the operation time memory 150, the ratio Tl/T of a human presence time Tl in a left zone L is calculated in step S17. The ratio Tl/T is compared with a predetermined reference value Ta (e.g., 1>Ta>0) at which a human is not present in a corresponding zone. If the ratio Tl/T is lower than the reference value Ta, the controller 100 determines that there are few people in the left zone L during the entire operation time T.

A ratio Tr/T of an accumulated time Tr for sensing a human in the right zone to the entire operation time T is compared with predetermined reference value Ta in step S17. If the ratio Tr/T are lower than a reference value Ta in step S17, there is few people even in the right zone during the entire operation time T.

Accordingly, if step S17 determines that a human is present in at least one zone between the right zone and the left zone, steps below step S18 are performed. If step S17 determines that no one is present in the right and left zones during the entire operation time T, the steps are repeated starting from step S10.

If it is determined that a human is present in either the left zone or the right zone during a predetermined time, an installation position of the air-conditioner and a driving range of the louver 130 are varied according to the accumulated human body sensing time, thereby controlling a wind direction of discharge air.

In a step S18, it is determined whether a left sensing time Tl for accumulating a human body presence time in the left zone is longer than the right human body presence time Tr. If the left sensing time Tl is longer than the right sensing time Tr in step S18, steps below step S19 are performed. If the left sensing time Tl is shorter than the right sensing time Tr in step S18, steps below step S24 are performed.

If the left sensing time Tl for accumulating a human body presence time in the left zone is longer than the right human body presence time Tr in step S18, a ratio Tr/Tl of a human presence time Tr in the right zone with respect to a human body presence time Tl in the left zone is calculated in step S19. In addition, step S19 determines whether the ratio Tr/Tl is beyond a predetermined proportional constant S1 (where, 1>S1>0). If the ratio Tr/Tl is beyond the first proportional constant S1 in step S19, step S20 is performed. In step S20, a driving range of the louver 130 is set such that a heat-exchanged air is uniformly discharged towards an entire range which is initially set as a driving range from the left zone to the right zone, and the driving of the louver 130 is controlled.

As shown in FIG. 2A, if the controller 100 determines that the air-conditioner is installed at a position corresponding to a center position of the room, a heat-exchanged air is discharged toward the entire range of the room in order to achieve a uniform air-conditioning effect in the air-conditioning space because the human presence time in the right zone is almost identical with that in the left zone.

Figure 2B:
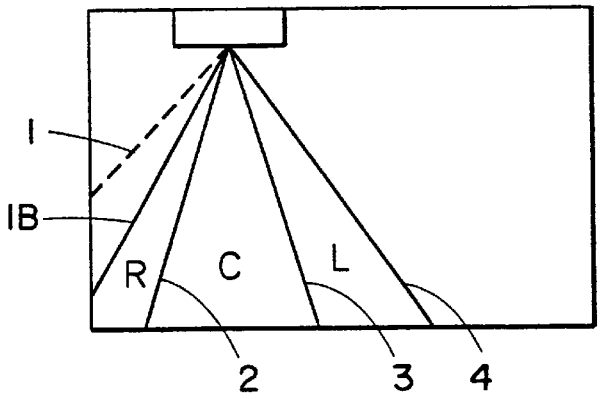

However, if the human body sensing time ratio Tr/Tl is below the first proportional constant S1 in step S19, a human body sensing time ratio Tr/Tl is compared with a second proportional constant S2 (where, 1> S1 <S2 >0) lower than the first proportional constant S1 in step S21. If the human body sensing time ratio Tr/Tl is beyond the second proportional constant S2 in step S21, step S22 controls a driving range of the louver 130 to discharge a heat-exchanged air toward the entire range except for ½ of the initially set right zone as shown in FIG. 2B. Since the human presence time Tl in the left zone is longer than the human presence time Tr in the right zone, the controller 110 discharges cool air from the left zone to ½ of the right zone, not discharging air toward a remaining ½ of the right zone, thereby preventing the unnecessary discharge of air toward unoccupied space or a wall.

Figure 2C:
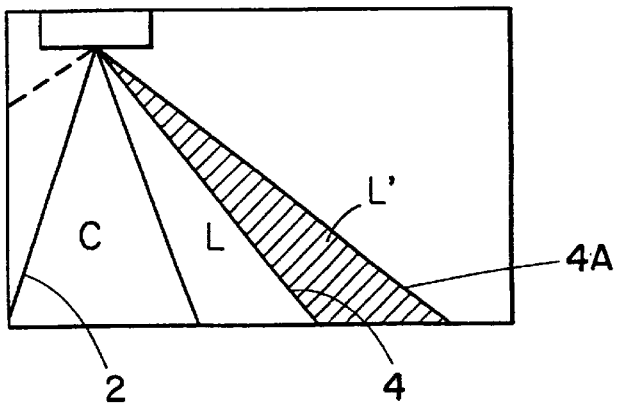

Also, if the ratio Tr/Tl is lower than the second proportional constant S2 in step S21, the air-conditioner is installed toward the right zone of the room as shown in FIG. 2C, and the controller 110 determines that a right sensing range of the human body sensor 210R corresponds to a wall or an obstacle. Accordingly, a range subtracting the right zone from the initially set entire range is determined as a compensation zone of a left outer side, and a driving of the louver 130 is controlled to discharge a heat-exchanged air into the left and center zones and even into the compensation zone of the left outer side.

Further, if the human body presence time Tr in the right zone is longer than the human body presence time Tl in the left zone in step S18, a human body presence time ratio in each zone is calculated in step S24. That is, a human body sensing time ratio Tl/Tr of the left zone with respect to the right zone is compared with the first proportional constant S1 in step S24. If the ratio Tl/Tr is beyond the first proportional constant S1 in step S24, the controller determines that the human presence time Tr in the right zone is almost identical with the human presence time Tl in the left zone, and sets a rotating range of the louver 130 in order to evenly discharge a cool air towards the initially set entire range in step S25.

Figure 2D:
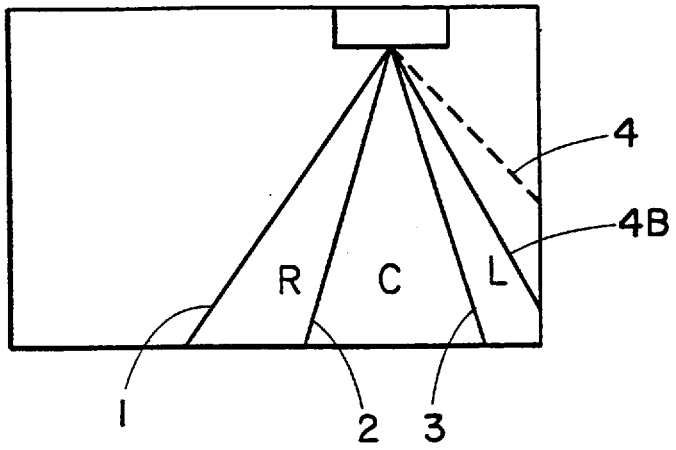

However, if the ratio Tl/Tr is below the first proportional constant S1 in step S24, the ratio Tl/Tr is compared with a second proportional constant S2 (where, S2< S1) in step S26. If the ratio Tl/Tr is beyond the second proportional constant S2 in step S26, the controller 110 determines that the air-conditioner is installed toward the left side of the room as shown in FIG. 2D. Accordingly, step S27 controls a driving range of the louver 130 in order to discharge a heat-exchanged air towards the entire range except for ½ of the initially set left zone.

Figure 2E:
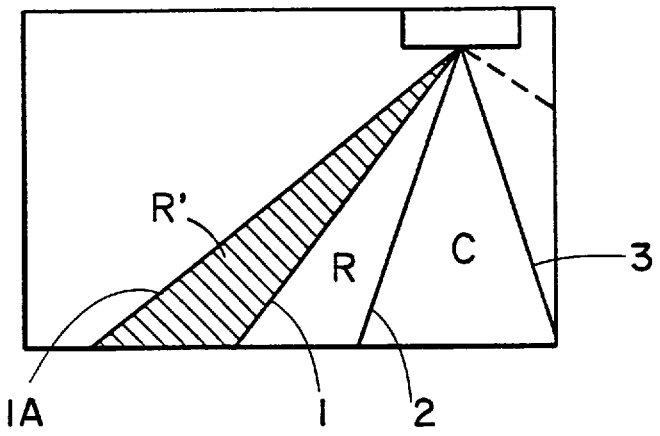

In addition, if the ratio Tl/Tr is below the second proportional constant S2 in step S26, the controller 110 determines that the air-conditioner is installed toward the left side of the room as shown in FIG. 2E, thereby determining that a left sensing range of the human body sensor corresponds to a wall or an obstacle. Therefore, in step S28, the left zone determined within a driving range of the louver 130 is excluded, the excluded range is determined as a compensation zone of the right outer zone, and a driving of the louver 130 is controlled to discharge the heat-exchanged air from the center zone to the compensation zone.

As described above, a wind direction control method for an air-conditioner varies a wind direction of discharge air according to a ratio of a human body sensing time in each indoor zone where the air-conditioner is installed, prevents the deterioration of air-conditioning performance and power-consumption caused by the discharge of air towards a wall or unoccupied space, thereby performing an effective air-conditioning operation.

What is claimed is:

1. A method of controlling an air conditioner which emits a flow of air into a room through an outlet having a wind direction control louver and an actuator for adjusting the louver, the method comprising the steps of:

A) discharging air into the room through the outlet within an air discharge range;

B) dividing the room into at least right and left sensing zones;

C) actuating a right human body sensor and a left human body sensor for sensing whether a human body is present in respective ones of the right and left sensing zones and determining for each of the zones a human body sensing time in which a human body is sensed;

D) determining a ratio of a first human body sensing time for a first of the zones to a second human body sensing time for a second of the zones; and E) activating the actuator to adjust the vanes for varying the air discharge range in accordance with the comparison of step D by selectively eliminating a predetermined portion of one of the zones from the air discharge range when the ratio determined in step D indicates that there is insufficient human body presence time in said one zone as compared to the other zone.

2. The method according to claim 1 wherein step B comprises dividing the room into left, center and right zones, and step C comprises actuating a left human body sensor, a center human body sensor, and right human body sensor.

* * * * *